US005193335A

United States Patent [19]

Mori

[11] Patent Number: 5,193,335

[45] Date of Patent: Mar. 16, 1993

[54] SPINNING APPARATUS

[75] Inventor: Shigeki Mori, Ohtsu, Japan

[73] Assignee: Murata Kikai Kabushiki Kaisha, Kyoto, Japan

[21] Appl. No.: 723,802

[22] Filed: Jul. 1, 1991

[30] Foreign Application Priority Data

Jul. 4, 1990 [JP] Japan ..... 2-176736

[51] Int. Cl.[5] ..... D01H 13/30; D02G 1/06; D02G 1/16

[52] U.S. Cl. ..... 57/296; 57/328; 57/333

[58] Field of Search ..... 57/295–298, 57/328, 331, 333, 341, 343, 344, 346, 348, 350

[56] References Cited

U.S. PATENT DOCUMENTS

| | | | |
|---|---|---|---|
| 2,080,905 | 5/1937 | Bartell | 57/297 |
| 3,577,872 | 5/1971 | Drummond | 57/296 |
| 3,676,992 | 7/1972 | Riley | 57/296 |
| 3,877,214 | 4/1975 | Van der Werf | 57/328 |
| 3,969,882 | 7/1976 | Cilloniz Oberti | 57/295 |
| 4,064,684 | 12/1977 | Nijhuis | 57/298 X |
| 4,598,538 | 7/1986 | Moore, Jr. | 57/295 X |
| 4,608,814 | 9/1986 | Moore, Jr. et al. | 57/295 X |
| 4,707,977 | 11/1987 | Cousin et al. | 57/295 X |
| 4,845,932 | 7/1989 | Sakai et al. | 57/328 X |
| 4,958,487 | 9/1990 | Suganuma et al. | 57/328 |

*Primary Examiner*—Daniel P. Stodola
*Assistant Examiner*—Michael R. Mansen
*Attorney, Agent, or Firm*—Spensley Horn Jubas & Lubitz

[57] ABSTRACT

A spinning apparatus in which moisture can be applied to spinning yarn by a simple apparatus. In a spinning apparatus wherein a yarn is manufactured by introducing a bundle of fiber into a passage for a bundle of fiber of a spindle being rotated at high speeds, a device for supplying water to a center portion of a yarn is provided to face an inlet of the passage for a bundle of fiber of the spindle.

8 Claims, 3 Drawing Sheets

SPINNING APPARATUS

FIELD OF THE INVENTION

This invention relates to a manufacturing apparatus for spinning yarns having a device capable of supplying water to the yarn.

RELATED ART STATEMENT

It is necessary that spinning yarns are traded in a state which contain moisture of moisture regain 8.5%, and water is applied to yarns for the purpose of enhancing the strength of yarns. To this end, in the past, spinning yarns are manufactured within a spinning mill with high humidity applied thereto or manufactured packages are introduced into a moisture-supplying chamber to apply moisture.

In a conventional moisture supplying method for spinning yarns, the spinning mill or the whole moisture supplying chamber has to be maintained at a high humidity. Therefore, much water is required, resulting in a large scaled dampener.

OBJECT AND SUMMARY OF THE INVENTION

An object of this invention is to provide a spinning apparatus in which moisture can be applied efficiently to spinning yarns by a simple apparatus.

For achieving the aforesaid object, the spinning apparatus of this invention is provided with a device for supplying water to a center portion of a yarn in the manufacturing process.

In the spinning apparatus configured as described above, water is supplied to a center of a yarn in the process by which yarns are produced, and water extends to the whole yarn to apply moderate moisture thereto.

DETAILED DESCRIPTION OF PREFERRED EMBODIMENT

An embodiment of the spinning apparatus according to the present invention will be described with reference to the drawings.

Figure 1:
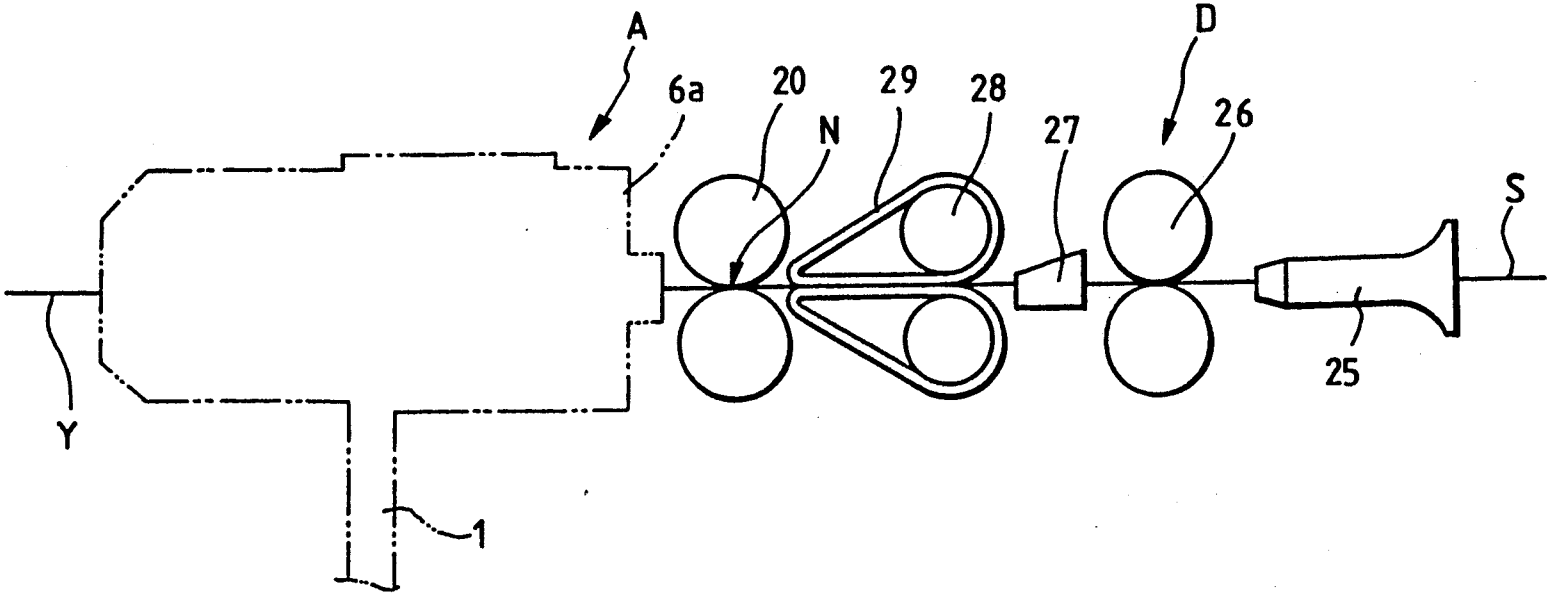
FIG. 1 is a schematic view showing an embodiment of a spinning apparatus to which is applied the apparatus of this invention.

The spinning apparatus A is arranged next to a draft part D comprising a pair of back rollers 26, arranged continuously to a sliver guide 25, a pair of middle rollers 28 each having an apron 29, and a pair of front rollers 20, as shown in FIG. 1. In FIG. 1, a line extending laterally designates a travel path of a bundle of fiber S or a yarn Y, and numeral 27 designates a sliver-width defining guide.

The detail of the spinning apparatus A will be described with reference to FIG. 2.

A support plate 1 secured to a frame has a hollow cylindrical bearing 2, a spindle 6 and a casing 3 for a rotary body 9 secured thereto. This casing 3 is composed of a pair of front and rear split dies, which are fixed by screws.

The spindle 6 is rotatably supported interiorly of the bearing 2 through bearings 4 and 5, and a hollow pulley 7 is mounted in the outer periphery of the spindle 6.

Numeral 8 designates an endless drive belt passed along the unit in contact with the outer periphery of the pulley 7 to rotate the spindle 6 at high speeds. The rotary body 9 is integrally provided at the position ahead of the bearing 5 of the spindle 6.

A passage 10 for a bundle of fiber extends through the center of the spindle 6. The center of the passage 10 and the center of the casing 3 are positioned on the same straight line coincided with the travel path of the bundle of fiber S.

The outside diameter of an inlet **6*a* of the spindle 6 is sufficiently small, and a portion continuous to the inlet 6*a* is formed into a conical portion 6*b* whose outside diameter increases toward the rotary body 9**.

The distance between the spindle inlet **6*a* and a nip point N of the front rollers 20** is set to be shorter than an average length of the fibers constituting the bundle of fiber S.

A portion for covering the spindle 6 and the rotary body 9 of the casing 3 forms a hollow chamber 11 in which a portion in the neighbourhood of the spindle 6 has a small-diameter cylindrical shape, and a portion continuous to the hollow chamber 11 forms a conical hollow chamber 12 opened at a large angle.

A portion ahead of the small-diameter hollow chamber 11 is cylindrical slightly larger than the diameter of the end of the spindle 6 by a nozzle block 23, the cylindrical portion serving as a guide passage of the bundle of fiber S. An annular hollow chamber 14 and a tangential air escape hole 15 continuous thereto are formed this side of the conical hollow chamber 12. An air suction pipe is connected to the air escape hole 15.

The casing 3 is interiorly formed with a hollow air reservoir 16 adjacent to the nozzle block 23. The nozzle block 23 is formed with four air jet nozzles 17 which are directed from the air reservoir 16 toward the inlet **6*a* of the spindle 6 and directed in a tangential direction with respect to the hollow chamber 11, and an air hose 19 is connected to the air reservoir 16 through a hole 18. The direction of the nozzles 17 is set to be the same as the rotational direction of the spindle 6**, and jet pressure is of the order of 4 $kg/cm^2$.

Compressed air supplied from the hose 19 flows into the air reservoir 16 and thereafter jets from the nozzles 17 into the hollow chamber 11 to generate a high speed flow of turning air in the neighbourhood of the spindle inlet **6*a***.

This air flow turns within the hollow chamber 11, after which the air flow is diffused outwardly while slowly turning within the conical hollow chamber 12 and guided toward an escape hole 15 and discharged. At the same time, the air flow generates a suction air flow which flows from the nip point N of the front rollers 20 into the hollow portion of the casing 3.

Furthermore, a water pouring guide block 13 is secured to the inner wall of the nozzle block 23. The water pouring guide block 13 has one end formed into a columnar shape projected in the form of a small-diameter rod, and one side thereof is cut to form a gap 24 adjacent to the nozzle block 23, which serves as a guide passage for the bundle of fiber S.

The water pouring guide block 13 is bored lengthwise thereof with a water guide path 22 coincided with a center line of the passage 10 of the spindle 6, to which water is supplied by a hose 31. Thereby, water is supplied into the yarn to secure the moisture regain (8.5% of yarn weight) to increase the strength of yarn, and oil can be also mixed into water. The diameter of the water guide path 22 is preferable smaller less than 1 mm, and the quantity of water supplied is 98 cc/hour. It is contemplated that water along with air is jetted from the nozzle 17 which jets a turning stream instead of supplying water from the center of the yarn. This is not preferable because water is stuck to the fibers and inside of the apparatus and the fibers are adhered to the inside of the apparatus. A water reservoir which supplies water to the surface of the yarn may be provided within the passage 10 of the spindle 6.

Figure 2:
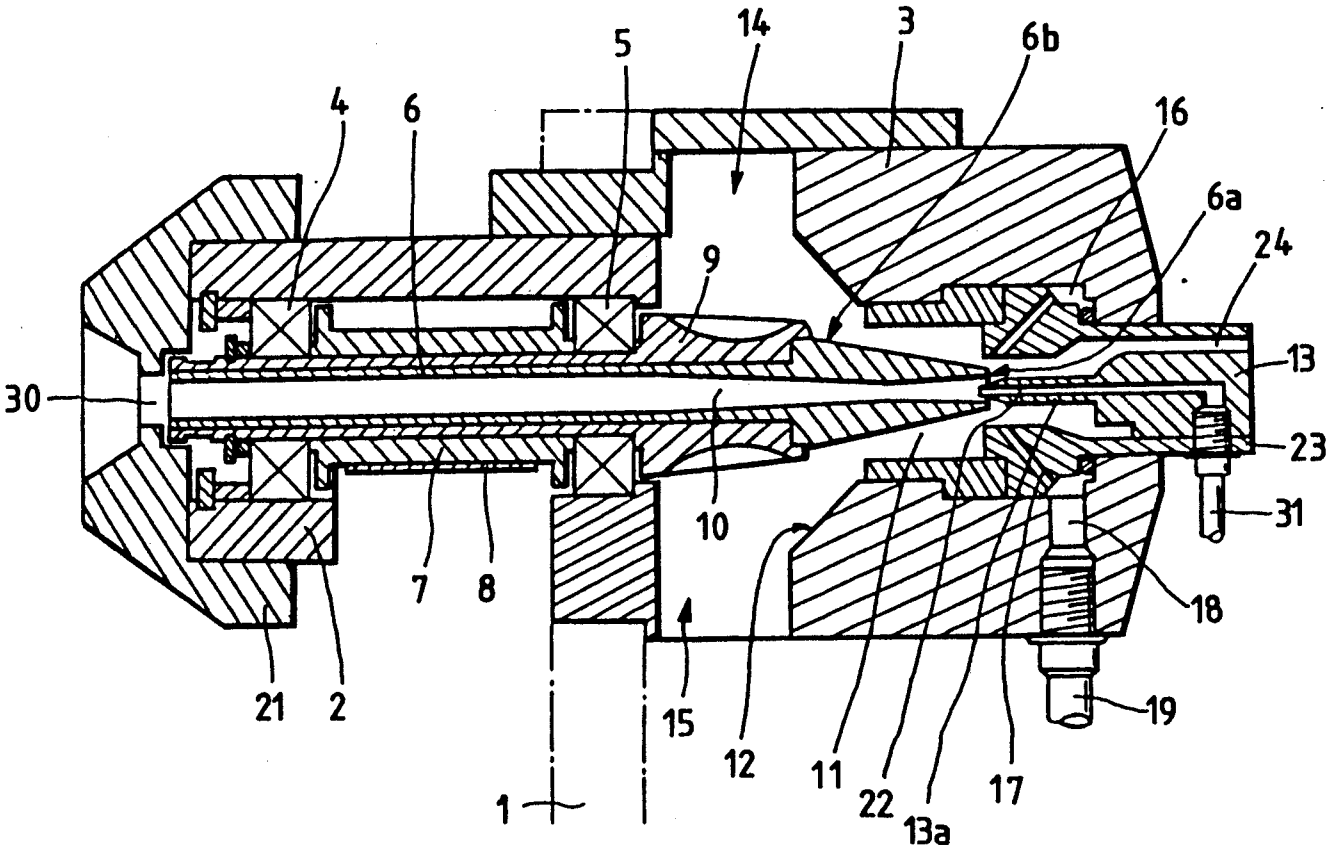
FIG. 2 is a sectional view of the apparatus according to this invention.

The extreme end of the rod-like projecting portion 13*a* of the water pouring guide block 13 faces the inlet 6*a* of the spindle 6, and FIG. 2 shows the case where it is at a position slightly entered into the passage 10 from the inlet 6*a* of the spindle 6. This state is most preferable, and the yarn to be manufactured shows an external appearance close to a ring yarn. However, a position away from the end of the inlet 6*a* can be employed depending upon the conditions, and yarns having an external appearance close to the ring yarn can be manufactured. These yarns are by no means inferior to the ring yarn even in the strength characteristic.

The rod-like projecting portion 13*a* of the water pouring guide block 13 has a function of a so-called false core which prevents the propagation of twist in the yarn forming process later described or temporarily performs the function of the center fiber bundle, performing the function which prevents the formation of a non-twisted core fiber bundle remarkably appearing in a conventional pneumatic bundled spinning yarn to form a yarn merely by the actually wound fibers.

Numeral 21 designates a cap.

Yarn was produced under the following conditions to measure the yarn characteristics:

Yarn speed: 100 m/min, total draft: 68, ratio of peripheral speed of delivery rollers to front rollers: 0.98, coarseness of a bundle of fiber for stopping and supplying a spindle: 28 G/Y, diameter of nozzle: 0.6 mm–6 pcs, angle of air injection: 45°, injection pressure: 4 kg/cm$^2$, diameter of rod-like projecting portion of a water pouring guide block: 1.2 mm, diameter of a water guide path: 0.2 mm, and quantity of water supplied: 89 cc/hour. The results (average values) are given in Table 1 below.

TABLE 1

| | | Supply of water | No supply of water |
|---|---|---|---|
| Immediately after spinning | Actual count | Ne 23.5 | Ne 24.1 |
| | Strength g/tex | 11.5 | 9.9 |
| | Elongation % | 5.3 | 4.7 |
| | Number of twist/m | 827 | 731 |
| | Water rate % | 6.5 | 3.2 |
| After left in a drying furnace for 5 hours at 40° C. | Strength g/tex | 9.4 | 9.6 |
| | Elongation % | 3.4 | 4.3 |
| | Number of twist/m | 908 | 797 |

Note:
The above no-supply-of water shows that operation was made by not supplying water from a water guide path in an experiment room dampened by a dampener.

It is understood from Table 1 that the dried yarn is weak and that when the yarn is produced by supplying water from the water guide path of the water pouring guide block, the strength of yarn and the number of twists are surely enhanced and the elongation lowers.

The manufacturing process of yarns by the real twist yarn manufacturing apparatus A will be described hereinafter.

Figure 3:
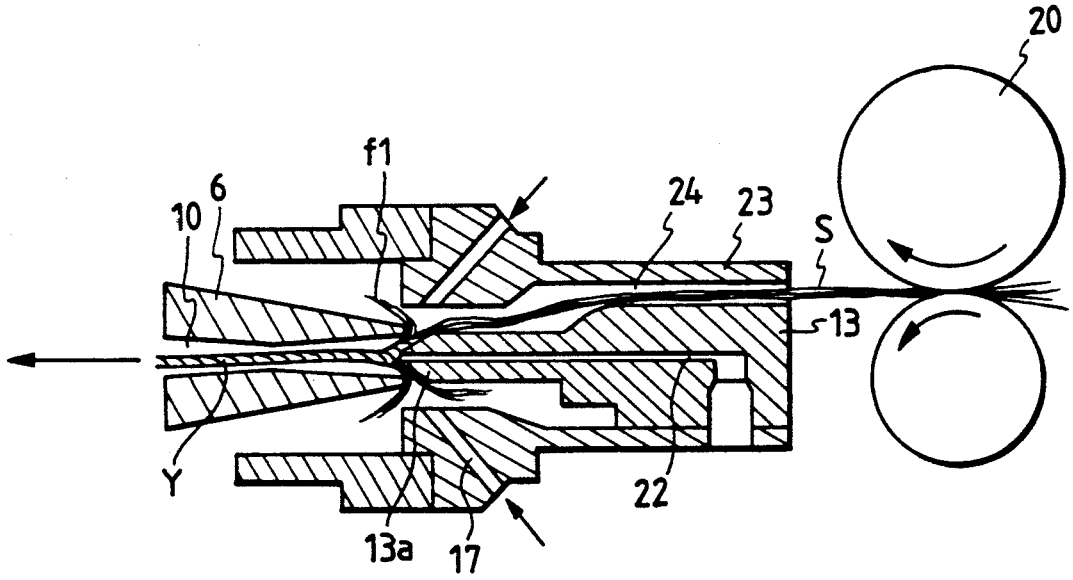
FIG. 3 is an enlarged sectional view of a main part of the apparatus of the present invention.

In FIG. 2 and FIG. 3, the fiber bundle S drafted by the draft device D and delivered from the front rollers 20 is drawn into the apparatus by a flow of air sucked from the gap 24 between the water pouring guide block 13 and the nozzle block 23. Prior to the delivery of the fiber bundle S from the front rollers 20, the extreme end of the suction pipe not shown is placed in contact with an outlet 30 of the cap 21 to generate a flow of air sucked into the spindle 6. Accordingly, the fiber bundle S moving into the gap 24 is sucked smoothly by the flow of air into the spindle 6.

The yarn sucked into the suction pipe passing through the spindle 6 is introduced into the piecing device by the movement of the suction pipe and pieced with the yarn on the package side introduced by a suction mouth.

The peripheral speed of the delivery roller provided at the downstream of the outlet 30 of the cap 21 is set to be slightly higher than that of the front roller 20 so as to always apply tension to the fiber bundle S passing through the apparatus A during spinning.

The fiber bundle S is introduced into the inlet 6*a* of the spindle 6 by the action of a jet air flow from the nozzle 17 to subject to the action of a flow of compressed air which turns in the vicinity of the spindle inlet 6*a* and is slightly temporarily twisted in the same direction. At this time, the fiber bundle S is not possible to assume a position within the space occupied by the rod-like projecting portion 13*a* by the presence of the rod-like projecting portion 13*a* of the water pouring guide block 13 (at that time, water is applied to the center of the fiber bundle S from the water guide path 22 of the water pouring guide block 13). Accordingly, all the fibers are to be positioned around the rod-like projecting portion 13*a* and directly exposed to the flow of air and separated from everywhere of the whole outer periphery, and the fibers positioned internally are also exposed to the flow of air to receive the force to be separated from the fiber bundle S. However, when the extreme end of the fiber is positioned at the inlet 6*a* of the spindle 6, the extreme end thereof is not easily separated because it is subjected to temporary twisting as described above. The rear end of the fiber is not yet separated because it is nipped between the front rollers 20 or it is far away from the nozzle 17 and is not much subjected to the action of air. The rear end of the fiber is separated from the fiber bundle S first when it is disengaged from the front rollers 20 and moved to the position being strongly subjected to the flow of air. The rear end of the fiber (f1) separated is wound about the inlet 6*a* portion of the spindle 6 once or plural times by the action of the air flow, and continuously slightly wound about the conical portion 6*b* of the spindle 6, after which it extends externally while being guided by the rotary body 9.

Furthermore, the fiber bundle S continues to travel downward in FIG. 2 whereas the spindle 6 is rotating, and therefore, the rear end of the fiber is gradually drawn while rotating around the fiber bundle S.

As a result, the fiber is spirally wound around the fiber bundle S, and the fiber bundle S is formed into a spun yarn Y, which passes through the fiber bundle passage 10.

The winding direction of the fiber is determined depending upon the direction of the nozzle 17 and the rotational direction of the spindle 6. Preferably, the turning direction of the air flow caused by the nozzle 17 is set in the same direction as the rotational direction of the spindle 6 so that the winding direction of the wound fiber is not disturbed and the extreme end of the fiber is not separated.

As mentioned above, according to the apparatus of the present embodiment, the false twist which tends to be propagated from the spindle 6 toward the front roller 20 is prevented from the propagation by the rod-like projecting portion 13*a* of the water pouring guide block 13, and the fiber bundle S moved out of the front rollers 20 is not twisted by the false twist but most of fibers are formed into wound fibers. This can be confirmed from the fact that in the case where the rod-like projecting portion 13*a* is not present, stripe portions in the travel direction are produced in the vicinity of the central portion widthwise of the roller of a flat fiber bundle delivered from the front rollers 20.

While in the above-described embodiment, the apparatus of the type in which twist is applied by the spindle has been explained, it is to be noted that application of the invention can be also made to other apparatuses, for example, apparatus for manufacturing bundled spinning yarns of a 2-nozzle type having a guide member provided at a first nozzle inlet, apparatus by way of nozzles and a nip type twister, spinning apparatus of a one-nozzle type depending on the conditions. The spindle 6 assists applying a twist to the yarn. Even if this is not rotated, manufacturing yarns can be made depending on the yarns. Accordingly, the spindle 6 is not necessarily rotated.

The invention being configured as described above, the following effects are provided.

That is, a necessary quantity of water can be efficiently applied to yarns by a simple device without making the interior of the spinning mill high humidity or separately providing a moisture-supplying room. The spinning properties are improved and in addition, water as well as fibers are not adhered to the apparatus. The production cost can be considerably lowered.

What is claimed is:

1. A spinning apparatus, comprising:

a casing;

a rotatable spindle disposed substantially within the casing, the rotatable spindle defining an axis of rotation; and a guide block disposed substantially within the casing, the guide block defining a guide path for introducing water to an interior portion of a yarn, the guide path defining an axis;

wherein the rotatable spindle and the guide path are arranged substantially coaxially.

2. The spinning apparatus of claim 1, further comprising a nozzle block disposed substantially within the casing, the guide block being disposed substantially within the nozzle block, the nozzle block and guide block defining a fiber bundle path.

3. The spinning apparatus of claim 2, wherein the nozzle block comprises at least one air jet nozzle directed toward the inlet of the spindle.

4. The spinning apparatus of claim 1, wherein the casing defines an air escape hole.

5. The spinning apparatus of claim 1, wherein the spindle comprises a conically shaped inlet.

6. The spinning apparatus of claim 1, wherein the guide block includes a columnar shaped end portion.

7. The spinning apparatus of claim 6, wherein the spindle defines an inlet and wherein a portion of the columnar shaped end portion is located within the inlet of the spindle.

8. The spinning apparatus of claim 1, wherein the water is introduced at a formation point of the yarn.

* * * * *